US012042114B2

(12) United States Patent
Buogo et al.

(10) Patent No.: US 12,042,114 B2
(45) Date of Patent: Jul. 23, 2024

(54) DOSING DEVICE, STORAGE CARTRIDGE, DOSING UNIT AND WATER-BEARING HOUSEHOLD APPLIANCE WITH AN AUTOMATIC DOSING SYSTEM

(71) Applicants: RECKITT BENCKISER (BRANDS) LIMITED, Berkshire (GB); BSH HAUSGERÄTE GMBH, München (GB)

(72) Inventors: Alberto Buogo, Hull (GB); Jakob Schultz, München (GB); Alexander Schiele, München (GB); Hallam Collings, Cambridgeshire (GB); Henry Matthew Lawrence Fletcher, Cambridgeshire (GB); Iain Christopher Smith, Cambridgeshire (GB); Jon Whadcoat, Cambridgeshire (GB)

(73) Assignees: Reckitt Benckiser (Brands) Limited, Berkshire (GB); BSH Hausgeräte GmbH, Munich (DE)

( * ) Notice: Subject to any disclaimer, the term of this patent is extended or adjusted under 35 U.S.C. 154(b) by 288 days.

(21) Appl. No.: 17/605,741

(22) PCT Filed: May 6, 2020

(86) PCT No.: PCT/EP2020/062609
§ 371 (c)(1),
(2) Date: Oct. 22, 2021

(87) PCT Pub. No.: WO2020/229268
PCT Pub. Date: Nov. 19, 2020

(65) Prior Publication Data

US 2022/0104683 A1 Apr. 7, 2022

(30) Foreign Application Priority Data

May 13, 2019 (EP) ..... 19173996
May 13, 2019 (GB) ..... 1906676

(51) Int. Cl.
*A47L 15/44* (2006.01)
*D06F 39/02* (2006.01)

(52) U.S. Cl.
CPC ..... *A47L 15/449* (2013.01); *A47L 15/4436* (2013.01); *A47L 15/4445* (2013.01); *A47L 15/4463* (2013.01); *D06F 39/026* (2013.01)

(58) Field of Classification Search
None
See application file for complete search history.

(56) References Cited

U.S. PATENT DOCUMENTS

2002/0117511 A1 8/2002 McNabb et al.
2005/0230427 A1 10/2005 Salvati et al.

FOREIGN PATENT DOCUMENTS

CN 101849812 A 10/2010
CN 106555306 A 4/2017
(Continued)

OTHER PUBLICATIONS

CNIPA; Office Action dated Oct. 17, 2023 in CN202080034700.6, filed May 6, 2020.
(Continued)

*Primary Examiner* — Rita P Adhlakha
(74) *Attorney, Agent, or Firm* — Dunlap Codding, P.C.

(57) ABSTRACT

The invention relates to a dosing device for dosing a detergent tablet provided by a storage cartridge to which the dosing device is attachable, the dosing device comprising a scoop and a plug, wherein the scoop is configured to pick up a detergent tablet from the storage cartridge, lift the detergent tablet to an opening in the scoop and transport the detergent tablet to a receiving chamber formed in the plug when scoop is turned in a first turning direction about a
(Continued)

rotational axis that crosses a gravitational vector, and the plug is configured to release the detergent tablet from the receiving chamber.

22 Claims, 12 Drawing Sheets

(56) References Cited

FOREIGN PATENT DOCUMENTS

| | | | |
|---|---|---|---|
| CN | 109310264 | A | 2/2019 |
| DE | 29615674 | U1 | 11/1996 |
| DE | 19540958 | A1 | 5/1997 |
| DE | 102016210397 | A1 | 12/2017 |
| EP | 1159913 | A1 | 12/2001 |
| JP | 63214290A | S | 9/1988 |
| JP | 2010535562 | A | 11/2010 |
| KR | 20030048508 | A | 6/2003 |
| KR | 20030056727 | A | 7/2003 |
| SU | 1659013 | A1 | 6/1991 |
| WO | 2009022101 | A1 | 2/2009 |
| WO | 2018/077686 | A1 | 5/2018 |
| WO | 2019063971 | A1 | 4/2019 |

OTHER PUBLICATIONS

Combined Search and Examination Report for corresponding United Kingdom application No. 1906676.0 mailed Sep. 30, 2019.

Search Report for corresponding United Kingdom application No. 1906676.0 mailed Mar. 16, 2020.

English translation of Search Report for corresponding Russian Application No. 2021136230 mailed Sep. 1, 2023.

Search Report and Written Opinion for corresponding International Application No. PCT/EP2020/062609, mailed Jul. 24, 2020.

English Translation of Office Action dated Jan. 25, 2024, in JP Appl. No. 2021-568237, filed Jul. 15, 2022.

DOSING DEVICE, STORAGE CARTRIDGE, DOSING UNIT AND WATER-BEARING HOUSEHOLD APPLIANCE WITH AN AUTOMATIC DOSING SYSTEM

CROSS-REFERENCE TO RELATED APPLICATIONS

This application is a U.S. National Phase of International Patent Application No. PCT/EP2020/062609, filed on 6 Mar. 2020, which claims priority to United Kingdom Application Serial No. 1906676.0 filed 13 May 2019 and European Application Serial No. 19173996.0 filed 13 May 2019. The entire contents of these applications are incorporated herein by reference in their entirety.

BACKGROUND OF THE INVENTION

1. Field of the Invention

The invention relates to a dosing device, a storage cartridge, a dosing unit and a water-bearing household appliance with an automatic dosing system.

2. Background

Known household appliances, for example dishwashers, typically have a dosing system, which consists of a chamber for storing a single dose of detergent. The user of the dishwasher has to fill the chamber with the detergent each time before starting a washing cycle. This is inconvenient for the user. Furthermore, such systems bear the risk that the user does not fill in the correct amount of detergent or forgets to fill in detergent at all. This can lead to bad or undesirable cleaning results. It is desired that an automatic dosing system is available, which automatically doses the correct amount of detergent at the correct timings during a washing cycle.

It is one objective of the invention to improve the dosing of detergent in a household appliance.

BRIEF SUMMARY OF THE INVENTION

In one aspect, the present invention provides dosing device for dosing a detergent tablet provided by a storage cartridge to which the dosing device is attachable, the dosing device comprising: a scoop; and a plug, wherein the scoop is configured to pick up a detergent tablet from the storage cartridge, lift the detergent tablet to an opening in the scoop and transport the detergent tablet to a receiving chamber formed in the plug when the scoop is turned in a first turning direction about a rotational axis that is perpendicular to a gravitational vector, and the plug is configured to release the detergent tablet from the receiving chamber.

In another aspect, the present invention provides a storage cartridge for storing a plurality of detergent tablets to which a dosing device according to any of the embodiments herein is attachable, the storage cartridge comprising a container having an opening spanning a plane and an inner surface having a first helical indent in at least a portion of the inner surface for conveying the detergent tablets towards the opening when the container is turned about an axis that is perpendicular to the plane spanned by the opening, wherein at least one of a pitch and/or a height and/or a flank geometry and/or a flank angle and/or a gradient of the first helical indent are determined as a function of the size and/or geometry of the detergent tablets.

In another aspect, the present invention provides a method for dosing a detergent tablet provided by a storage cartridge, comprising: attaching a dosing device to the storage cartridge to form a dosing unit; rotating the dosing unit in a first turning direction about a rotational axis that is perpendicular to a gravitational vector such that a scoop of the dosing device picks up a detergent tablet from the storage cartridge, lifts the detergent tablet to an opening in the scoop and transports the detergent tablet to a receiving chamber formed in a plug of the dosing device; and actuating the plug for releasing the detergent tablet stored in the receiving chamber for dosing the detergent tablet.

In another aspect, the present invention provides a water-bearing household appliance, particularly a dishwasher or washing machine, comprising an automatic dosing system configured for automatically dosing a detergent tablet provided by a storage cartridge configured for storing a plurality of detergent tablets into washing liquor for washing articles, comprising a receiving portion configured for receiving the storage cartridge and a driving unit configured for actuating a dosing device that is attachable to the storage cartridge for dosing the detergent tablet, wherein the dosing device is configured according to any of the embodiments described herein and the storage cartridge is configured according to any of the embodiments described herein.

These and other objects, features and advantages of the present invention will become more apparent upon reading the following specification in conjunction with the accompanying description, claims and drawings.

BRIEF DESCRIPTION OF THE DRAWINGS

The accompanying Figures, which are incorporated in and constitute a part of this specification, illustrate several aspects described below.

DETAILED DESCRIPTION OF THE INVENTION

Figure 1:
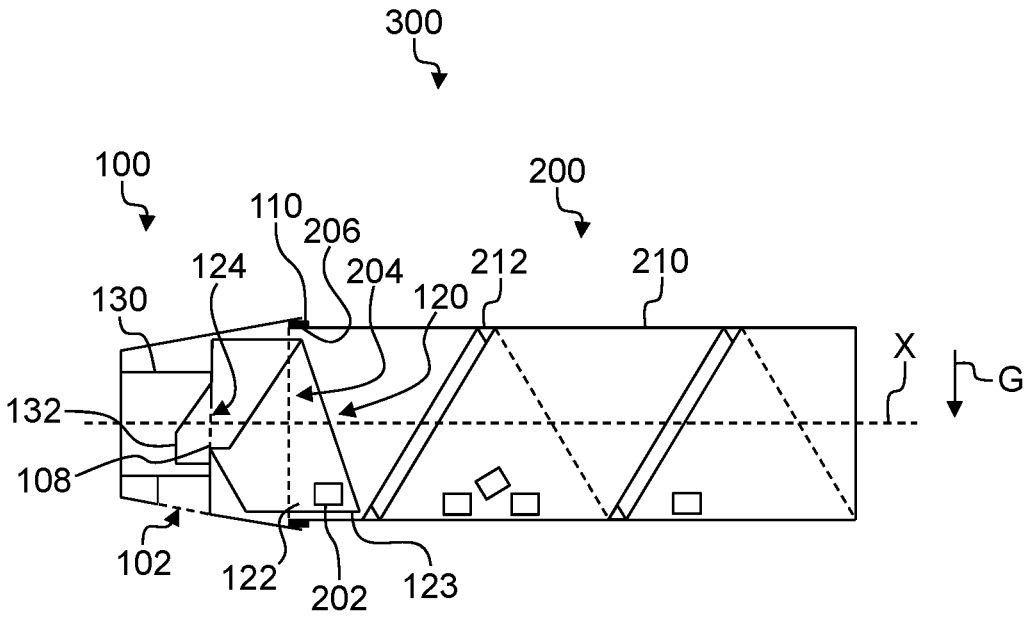
FIG. 1 shows a schematic sectional view of a first example of a dosing unit.

According to a first aspect of the invention, a dosing device for dosing a detergent tablet provided by a storage cartridge to which the dosing device is attachable is suggested. The dosing device comprises a scoop and a plug. The scoop is configured to pick up a detergent tablet from the storage cartridge, lift the detergent tablet to an opening in the scoop and transport the detergent tablet to a receiving chamber formed in the plug, when the scoop is turned in a first turning direction about rotational axis that is perpendicular to a gravitational vector. The plug is configured to release the detergent tablet from the receiving chamber.

This dosing device can be used particularly in conjunction with the storage cartridge. For example, the storage cartridge is implemented for storing a plurality of detergent tablets and the dosing device is attached to the storage cartridge. Then, the assembly may favorably be used in a water-bearing household appliance, in particular a dishwasher or a washing machine, for providing detergent for multiple washing cycles, without the need to fill in detergent before each cycle.

The dosing device has the advantage of being arranged to pick up and release a single or a number, preferably a predefined number, of detergent tablets stored in the storage cartridge reliably and in a simple way by turning the scoop or the whole dosing device about a specific rotational axis. For example, the rotational axis may be defined by an axis that extends in an attachment direction when the dosing device is attached to the storage cartridge. "An" or "one" is not to be understood as limiting to exactly one element but multiple elements may be provided unless otherwise specified.

In the following, actuating the dosing device means that the dosing device is employed according to its intended use, that is, picking up a detergent tablet from a storage and releasing it. Favorably, the dosing device allows to release a predefined number of detergent tablets with each actuation. When it is stated that the scoop is configured for picking up a detergent tablet, this is not to be understood in the sense that the scoop is configured for picking up exactly one detergent tablet. Rather, the scoop may be configured for picking up any number of detergent tablets. The maximum number will depend on both the details of the scoop as well as the geometry of the detergent tablets.

The dosing device may comprise several elements, such as the scoop and the plug, even if not mentioned explicitly. The elements of the dosing device are preferably made from polymeric materials which are suitable for injection molding. Additionally, the elements may be made from metal and/or a composite material and/or the elements may be coated.

The scoop has an opening which the detergent tablet has to pass for dosing. Preferably, the opening is a central opening according to a cross-section of the scoop in a direction perpendicular to an attachment direction of the dosing device to the storage cartridge. However, the opening can also be eccentrically.

The rotational axis is, for example, a symmetry axis of the opening of the scoop in case of a central opening and may be coaxial to a symmetry axis of an eccentrical opening. The rotational axis is considered to be perpendicular to the gravitational vector even when an angle between the rotational axis and the gravitational vector is less than 90 degrees, and particularly up to 45 degrees.

The plug is configured to release the detergent tablet from the receiving chamber, for example by clearing an outlet arranged on a side-wall of the dosing device. Saying that the receiving chamber is formed in the plug is to be understood in the sense that there is a portion formed in the plug or at the plug that is designed to hold the detergent tablet back before the detergent tablet is released. Particularly, the receiving chamber may be formed between the scoop and the plug and/or a further element.

The dosing device may be removably attachable to the storage cartridge, such that it can be removed in order to refill or replace an empty storage cartridge. Alternatively, the dosing device may attachable to the storage cartridge in a way that does not allow removal when used as intended.

The detergent tablets are preferably provided as formed bodies comprising a specific detergent formulation and having a specific size and geometry. The detergent tablets preferably comprise one or more active ingredients for an automatic washing process. As will be appreciated by the skilled person, the nature of the active ingredient(s) used in the detergent tablets will vary depending on the desired application. When used inside a dishwasher, the detergent tablets may, for example, comprise an active ingredient performing a dishwasher detergent, rinse aid, machine cleaner or dishwasher deodorizing function. In the context of laundry washing machines, the detergent tablets may, for example, comprise an active ingredient performing a laundry detergent or fabric softener function. Suitable active ingredients will be known to the skilled person; examples include bleach, bleach activator, bleach catalyst, enzyme, surfactant, builder, pH-adjusting agent, corrosion inhibitor, and fragrance.

For example, each detergent tablet contains a unit dose of the active ingredient, i.e. the entire amount of the active ingredient desired to be used in the washing process, such that only one detergent tablet of that active ingredient needs to be dispensed per washing process. In other embodiments, it may be an advantage for the unit dose of the active ingredient to be provided by more than one detergent tablet. For example, in some cases a single detergent tablet containing the entire unit dose may be rather large or heavy, and dosing may be more effective or reliable using multiple smaller or lighter detergent tablets. Preferably, the desired dose of the active ingredient is provided by no more than 10 detergent tablets, preferably no more than 9, 8, 7, 6, 5, or 4 detergent tablets. Preferably, the unit dose is provided by 1, 2, 3 or 4 detergent tablets. Another useful option is to provide detergent tablets each of which contains an amount of active ingredient that corresponds to no more than one unit dose of the active ingredient for at least one washing process of the automatic washing machine. For example, the dishwasher or washing machine is configured to allow selection between various different modes of operation, such as an intensive wash program and a light wash program, which require different amounts of the active ingredient. Thus, a number of detergent tablets may be dosed during one mode of operation and a different number of detergent tablets are dosed during a different mode of operation. For example, one detergent tablet may be dosed during a wash program for a certain soiling level and two detergent tablets during a wash program designed for a higher level of soiling. The detergent tablets may be of any suitable form, such as solid, gel tab, or water soluble package/container (preferably of low deformability). Preferably, at least the exterior of the detergent tablets are solid. For example, a capsule of a dissolvable (preferably hard) shell material could enclose a powder, liquid or gel composition. Advantageously, however, the detergent tablets are formed of a compressed powder. Each detergent tablet may, for example, be single phase or multi-layered, and may be otherwise structured to ensure that each active ingredient is released from the detergent tablet at the most optimal time. The detergent tablets may be wrapped in a film of water-soluble material, but preferably they are unwrapped. They may be coated with a suitable coating, e.g. to reduce friability. The detergent tablets may be of any suitable shape, such as cylindrical, disc-shaped, spherical, spheroidal, or cuboid. In an embodiment, each detergent tablet has at least one flat face. Preferably, the detergent tablets are cylindrical or disc-shaped, since spherical detergent tablets are more difficult to manufacture whilst shapes such as cuboid are less easily dispensed. In the case of a cylindrical detergent tablet, preferably the length of the tablet is up to 5% more or less than the diameter of the detergent tablet. When the detergent tablet has edges, preferably at least some of these edges are chamfered and/or filleted to reduce the liability to chip during manufacture and whilst the detergent tablet is in the dosing device. Preferably the chamfer has an angle of 15 to 20 degrees.

In an embodiment, each detergent tablet has a weight of: at least 0.1 g, at least 0.5 g, at least 0.7 g, at least 1 g, at least 1.2 g, at least 1.5 g, at least 2 g, at least 3 g, at least 4 g, or at least 5 g; and/or up to 15 g, up to 14 g, up to 13 g, up to 12 g, up to 11 g, up to 10 g, up to 9 g, up to 8 g, up to 7 g, or up to 6 g. In an embodiment, each detergent tablet has a maximum length and/or diameter of: at least 5 mm, at least 6 mm, at least 7 mm, at least 8 mm, at least 9 mm, or at least 10 mm; and/or up to 20 mm, up to 19 mm, up to 18 mm, up to 17 mm, up to 16 mm, or up to 15 mm.

Preferably, the detergent tablets are formed such that a high storage density in the storage cartridge can be achieved and the dosing function of the dosing device is supported. Further, the detergent tablets preferably have a form that is easily produced. For example, the detergent tablets have a cylindrical shape, wherein a diameter and a height of the cylinder have similar dimensions, that is, an aspect ratio is of the order of 0.2-1.

According to an embodiment, the scoop and the receiving chamber are implemented as a function of the geometry of the detergent tablets such that the dosing device is configured for dosing a predetermined number of detergent tablets, preferably a single detergent tablet, each time the dosing device is actuated for dosing the detergent tablet.

This ensures that the number of detergent tablets that are dosed each time the dosing device is actuated is predetermined. For example, the receiving chamber is limited to a certain volume and/or certain geometry which can only take up the predetermined number of detergent tablets.

In embodiments, further elements of the dosing device and/or a specific arrangement of the above elements may be employed for providing that the predetermined number of detergent tablets is obtained. In further embodiments, the predetermined number may be selected from a plurality of predetermined numbers and the dosing device may be adjustable according to the selected predetermined number. For example, in a first dosing operation the predetermined number is three and the dosing device is adjusted such that exactly three detergent tablets are released. In a second dosing operation, the predetermined number is five and the dosing device is adjusted such that exactly five detergent tablets are released.

By implementing the dosing device such that only a single detergent tablet is dosed each time the dosing device is actuated, it is possible to finely adjust the amount of detergent that is released each time the dosing device is actuated.

According to a further embodiment, the dosing device comprises a sealing portion for engaging with a corresponding sealing portion arranged on the storage cartridge for sealing an inner volume of the storage cartridge from the environment when the dosing device is attached to the storage cartridge.

The dosing device may comprise a sealing element, such as a lip-seal structure and/or a gasket. Preferably, the sealing portion is implemented such that it is impermeable to fluids of all kinds, in particular humidity, when it is sealed. This has the advantage that detergent tablets stored in the storage cartridge are not affected concerning their physical and/or chemical properties, in particularly do not dissolve or decompose and/or become sticky inside the storage cartridge, when the storage cartridge is placed inside a water-bearing household appliance.

According to a further embodiment, the dosing device comprises connection means for engaging with corresponding connection means arranged on the storage cartridge for securely fixing the dosing device on the storage cartridge in a predefined relative angular position.

Preferably, the dosing device and the storage cartridge are rotationally fixed to each other when the dosing device is attached to the storage cartridge.

For example, the connection means comprise a snap-fit that securely fastens the dosing device to the storage cartridge. For example, a snap-fit may be designed such that the dosing device is not easily removed once it is attached to the storage cartridge. This can be useful in terms of safety, because the detergent tablets stored in the storage cartridge may be irritating, corrosive or harmful. The dosing device may also be welded or glued to the storage cartridge. In this case, the connection means may be implemented as portions having corresponding shapes such that welding or gluing is achieved with ease.

The connection means are preferably implemented such that the dosing device can only be attached in a predefined relative angular position to the storage cartridge. For example, when both the dosing device and the storage cartridge have a generally circular cross-section, there are special features which allow to define a preferred direction for each the dosing device and the storage cartridge. The predefined relative angular position may then be given as a certain angle between the preferred directions of the dosing device and the storage cartridge.

In embodiments, the dosing device may comprise a seal-opening portion that is configured for breaking a seal arranged on the storage cartridge when the dosing device is fixed to the storage cartridge. The seal may be implemented as a foil, for example. This has the advantage, that the storage cartridge remains sealed and closed until the dosing device is attached to it, thus reducing input of fluids into its interior and reducing a risk of spilling the stored detergent tablets.

According to a further embodiment, the scoop comprises a pick-up portion for picking up the detergent tablet and lifting it to the opening in the scoop that leads to the receiving chamber, wherein a surface of the pick-up portion is formed as a spirally curved plane.

By implementing the scoop this way, the lifting-by-turning functionality is provided. For example, the pick-up portion has a shape like a snails house, that is, a tapered helical shape. When a central axis of the spirally curved plane is essentially perpendicular to the gravitational vector, a detergent tablet residing on the pick-up portion will slide on the surface when the scoop is turned and stay in the lowest position possible, driven by gravitation. At the same time, it will be lifted and transported further towards the opening in the scoop. The skilled person will understand that other geometries of the pick-up portion that provide the same lifting and transporting by turning functionality are also encompassed by this description.

Preferably, the pick-up portion of the scoop reaches into the inner volume of the storage cartridge when the dosing device is attached to it. This ensures that the detergent tablets can be picked up by the scoop. In this sense, the scoop has a certain effective range, which essentially depends on the distance the pick-up portion reaches into the storage cartridge.

The pick-up portion may be in contact with an inner surface of the storage cartridge when it is attached. However, a distance may be formed between the pick-up portion and an inner surface of the storage cartridge such that detergent powder and/or pieces of broken detergent tablets are not picked up by the pick-up portion, but instead slide underneath the pick-up portion. By setting the distance, a minimum size of detergent pieces or particles that can be dosed by the dosing device may be defined. All pieces or particles smaller than the minimum size will not be dosed, that is, they will be retained in the storage cartridge.

According to a further embodiment, a width of the surface of the pick-up portion of the scoop increases with an increasing diameter of the surface of the pick-up portion.

This allows the pick-up portion to reach into the storage cartridge without occupying too much space inside the storage cartridge. Preferably, the width of the pick-up portion is set as a function of the size of the detergent tablets. This helps to individualize the detergent tablets so that a specific number of detergent tablets is released each time the dosing device is actuated. The distance the pick-up portion reaches into the storage cartridge when attached may be called an effective range of the scoop.

Preferably, a trailing edge of the pick-up portion comprises a ridge for delimiting the pick-up portion to ensure that detergents tablets do not easily fall off the pick-up portion, but can be transported further by the pick-up portion. In this sense, the pick-up portion acts similarly to a screw drive. Further, the scoop may be designed such that when the predetermined number of detergent tablets is received in the receiving chamber, any further detergent tablet lifted by the scoop to the opening will fall off the scoop and not pass through the opening. This ensures that exactly the predetermined number of detergent tablets is released.

In embodiments, a tooth may be formed on the leading edge at a position far from the opening. Such tooth can assist in picking up a detergent tablet by catching it and pushing the detergent tablet towards the scoop or the pick-up portion. The tooth ensures that a detergent tablet that came into the effective range of the scoop cannot escape the pick-up portion anymore, and thus secures a reliable operation.

In embodiments, the leading edge may be curved, such that a detergent tablet sitting before the leading edge is pushed towards the opening. This embodiment ensures that a detergent tablet that came into the effective range of the scoop cannot escape the pick-up portion anymore, and thus secures a reliable operation.

According to a further embodiment, the dosing device comprises engagement means for engagement with a driving device of an external driving unit for turning the dosing device in the first turning direction and for holding the dosing device fixed.

This embodiment provides secure driving of the dosing device and storage cartridge when the dosing device is attached to the storage cartridge. The engagement means are configured to transmit a sufficient torque for turning the dosing device.

According to a further embodiment, the plug is held in the dosing device movably between a closed position and a release position, wherein when the plug is in the closed position, the detergent tablet received from the scoop is stored in the receiving chamber, and when the plug is in the release position, an outlet in a side-wall of the dosing device is cleared, such that the detergent tablet stored in the receiving chamber is released, and wherein when the plug is in the closed position, the dosing device is sealed impermeably to fluids of all kinds.

This embodiment ensures that when the dosing device is attached to a storage cartridge the inner volume of the storage cartridge is sealed when the plug is in the closed position. This can significantly reduce the input of fluids, especially of humidity, into the storage cartridge. This helps to prevent the detergent tablets from dissolving, decomposing and/or becoming sticky inside the storage cartridge. For example, the dosing device comprises specific sealing elements or sealing means for providing the seal.

Preferably, in its intended use, the dosing device is arranged such that the outlet is facing downwards when the plug is brought into the release position, such that the gravitational force pulls the detergent tablet out of the receiving chamber.

According to a further embodiment, the plug is shaped as a cylinder, an engaging section for engagement with a driving element of an external driving unit is arranged on one face of the cylinder and the receiving chamber is arranged on the other face of the cylinder, wherein the plug is arranged in the dosing device such that the receiving chamber is facing towards the opening of the scoop.

According to a further embodiment, the plug has an external thread that engages with an internal thread of the dosing device such that when the plug is rotated relative to the dosing device in a first rotation direction about a central axis of the cylinder, the plug is moved from the closed position to the release position by being displaced laterally away from the opening of the scoop, and when the plug is rotated relative to the dosing device in a second rotation direction oppositely the first rotation direction, the plug is moved from the release position to the closed position by being displaced laterally towards the opening of the scoop.

This embodiment allows to move the plug easily by rotating the plug relative to the dosing device. Preferably, the dosing device is kept fixed in a predefined position and then the plug is rotated.

In embodiments, the external thread on the plug is designed such that the plug is stopped by a radial stopper when moved from the closed position to the release position or vice versa. For example, the external thread on the plug does not extend from the one face until the other face of the cylinder, but ends before, forming a radial stopper at each end of the thread. Advantageously, the internal thread of the dosing device is specifically adapted in this embodiment. This embodiment several advantages. First, the plug cannot be screwed out too far but is stopped at a predefined extension. Second, the plug is also stopped by the radial stopper when moved to the closed position, which ensures that the plug reaches a predefined closed position. Therefore, a sealing element for sealing the dosing device can be designed such that the seal is achieved securely when the plug is in the predefined closed position. This further allows to adjust the torque required for engaging or disengaging the seal, because a material contact or deformation for forming the seal is easily reproducible by the predefined closed position.

According to a further embodiment, the inner surface of the plug delimiting the receiving chamber has an inclined plane with respect to the cylindrical outer surface of the plug in at least one section.

This embodiment ensures that the detergent tablet stored in the receiving chamber is actuated or rocked when the plug is moved from the closed position to the release position by turning the plug in the first rotation direction relative to the dosing device, which guarantees that the detergent tablet will fall out of the receiving chamber as soon as the outlet is clear.

According to a further embodiment, the dosing device comprises a lip that is arranged between the receiving chamber and the opening of the scoop for securely holding back the detergent tablet stored in the receiving chamber.

This embodiment ensures that the detergent tablet will not drop out of the receiving chamber back into the storage cartridge, even if the dosing device is exposed to vibrations of slight shocks from outside. Further, the rocking of the detergent tablet due to the inclined plane of the receiving chamber when the plug is turned will not kick the detergent tablet out of the receiving chamber back into the storage cartridge.

According to a second aspect of the invention, a storage cartridge for storing a plurality of detergent tablets to which a dosing device according to the first aspect is attachable is suggested. The storage cartridge comprises a container having an opening spanning a plane and an inner surface having a first helical indent in at least a portion of the inner surface for conveying the detergent tablets towards the opening when the container is turned about an axis that is perpendicular to the plane spanned by the opening. A pitch and/or a height and/or a flank geometry and/or a flank angle and/or a gradient of the first helical indent are determined as a function of the size and/or geometry of the detergent tablets.

The axis is considered to be perpendicular to the plane spanned by the opening even when an angle between the axis and the plane is less than 90 degrees, and particularly up to 45 degrees.

This storage cartridge is favorably configured to store a large number of detergent tablets, for example up to 200 detergent tablets, preferably at least 80 detergent tablets. Thus, multiple cleaning cycles can be performed with the water-bearing household appliance, such as a dishwasher or washing machine, without the need to refill detergent.

Preferably, the detergent tablets are loosely filled into the container. Preferably, they are randomly oriented therein.

For example, the container has an elongated shape that extends in a direction parallel to the axis. For example, the container has a form of a cuboid. Preferably, the container has a form of a cylinder or a cone. Further, a cross-section in a plane orthogonal to the extension direction of the container may have a form of any regular polygon, such as regular triangle, regular rectangle and so on, or a regular star shape.

For example, the inner surface may be cylindrical or conical and the opening is arranged on a front face of the cylinder or cone. Then, the axis is parallel to a symmetry axis of the cylinder or cone. The term "parallel" is not to be understood in a precise geometric way, but to include directions that form an angle of up to 45° with the symmetry axis.

The first helical indent that is formed in at least a portion of the inner surface provides a conveying mechanism for the detergent tablets when the storage cartridge is turned about the axis perpendicular to the plane spanned by the opening. Favorably, the first helical indent is formed as small as possible, so as not to occupy much space inside the container, but big enough so that transport of the detergent tablets is secured. The first helical indent may be provided by an inner surface having a regular polygonal cross-section in a first plane orthogonal to the axis, wherein the cross-section of the inner surface in a second plane offset from but parallel to the first plane has the same regular polygonal shape, but is rotated about a certain angular degree. That is, the first helical indent may be formed similar to the rifling of a gun barrel.

Preferably, the axis coincides with the rotational axis about which the dosing device needs to be turned in order to provide the specific functions of the dosing device.

Preferably, the first helical indent is formed such that when the dosing device is attached to the storage cartridge, by turning the assembly of the dosing device with the storage cartridge in a first turning direction about the axis, both conveying of detergent tablets towards the opening, and thus to the dosing device, as well as picking up, lifting and transporting of the detergent tablet by the dosing device is performed. This ensures that when the assembly is turned in this way, the dosing device does not starve from detergent tablets, because these are being transported simultaneously to the effective range of the dosing device.

The pitch of the helical indent denotes, for example, the distance between two points on the helical indent that are connected by a 360° turn along the helical indent.

The flank angle denotes, for example, an angle between a front side or a rear side of the helical indent with respect to the inner surface.

The gradient of the helical indent denotes, for example, an angle between the helical indent and a plane that is orthogonal to the symmetry axis of the inner cylindrical surface.

The pitch, height, flank geometry, flank angle and/or a gradient of the first helical indent may further be determined as a function of an angle formed between the first direction and a gravitational vector when the cartridge is arranged for use as it is intended.

The storage cartridge is not limited to the described embodiment. Particularly, any storage cartridge to which the dosing device according to the first aspect may be attached and that provides a plurality of detergent tablets to be dispensed from the storage cartridge via the dosing device in a defined manner is to be considered to fall under the scope of the described storage cartridge. That is, in an embodiment of the storage cartridge in which one or more of the elements described are not present or replaced by some other element or means that fulfil the described function, that embodiment falls under the scope of the described embodiment.

According to an embodiment, the opening is arranged at one end of the storage cartridge to which the dosing device is attachable, wherein the storage cartridge comprises connection means for engaging with corresponding connection means arranged on the dosing device for attaching the dosing device to the storage cartridge on the opening in a predefined relative angular position.

For example, the connection means comprise a snap-fit that securely fastens the dosing device to the storage cartridge. For example, a snap-fit may be designed such that the dosing is not easily removed once it is attached to the storage cartridge. This can be useful in terms of safety, because the detergent tablets may be irritating, corrosive or harmful. The dosing device may also be welded or glued to the storage cartridge. In this case, the connection means may be implemented as portions having corresponding shapes such that welding or gluing is achieved with ease.

The connection means are preferably implemented such that the dosing device can be attached to the storage cartridge only in a predefined relative angular position. For example, when both the dosing device and the storage cartridge have a generally circular cross-section, there are special features which allow to define a preferred direction for each the dosing device and the storage cartridge. The predefined relative angular position may then be given as a certain angle between the preferred directions of the dosing device and the storage cartridge.

According a further embodiment, the predefined relative angular position is set such that a relative position between a leading edge of a pick-up portion of a scoop of the dosing device and an end-point of the first helical indent on the side of the opening correspond to each other.

This embodiment ensures a reliable pick up of the detergent tablets by the scoop and the dosing device. Thus, the reliability of the dosing function of the assembly is increased.

For example, the leading edge of the scoop and the end-point of the first helical indent are, when the dosing device is attached to the storage cartridge, arranged in close contact to each other.

According to a further embodiment, a second helical indent is formed in at least a portion of the cylindrical inner surface of the container, wherein a pitch, a height, a flank geometry, a flank angle and/or a gradient of the second helical indent are different to the pitch, the height, the flank geometry, the flank angle and/or the gradient of the first helical indent and are selected such that detergent powder formed by abrasion from the detergent tablets stored in the storage cartridge is retained in the container when the container is turned for conveying the detergent tablets.

This embodiment has the advantage that detergent powder that may form by abrasion from the detergent tablets during actuation of the storage cartridge, for example when the storage cartridge is transported, is held back in the container. Therefore, a risk of jamming any movable parts by such powder particles, for example a plug in the dosing device, can be avoided. Further, a sealing function of a seal will not be compromised by the powder.

For example, the second helical indent has an inverse helicity with respect to the first helical indent and has a height that is selected such that it does not convey detergent tablets. Further, the second helical indent may be formed along the full length of the inner cylindrical surface and the first helical indent may have some smaller discontinuities. Then, when the storage cartridge is turned such that detergent tablets are conveyed towards the opening by the first helical indent, the detergent powder is conveyed in the opposite direction by the second helical indent. The discontinuities in the first helical indent allow the detergent powder to slide through, preventing the powder to be conveyed by the first helical indent.

Alternatively, the second helical indent may have a stationary form, that is, it may comprise a number of circular indents, which means that the gradient of the second helical indent is zero. While the detergent tablets may be conveyed over these circular indents by the first helical indent, detergent powder will effectively be held back.

According to a further embodiment, the storage cartridge has a sealing portion for engaging with a corresponding sealing portion arranged on the dosing device for sealing an inner volume of the storage cartridge from the environment when the dosing device is attached to the storage cartridge.

This embodiment ensures that, when the dosing device is attached to the storage cartridge, the inner volume of the storage cartridge is sealed. This can significantly reduce or prevent fully the input of fluids, especially of humidity, into the storage cartridge. This helps to prevent the detergent tablets from dissolving, decomposing and/or becoming sticky inside the storage cartridge. Preferably, the seal is impermeable to fluids of all kinds.

According to a third aspect of the invention, a dosing unit comprising a dosing device according to the first aspect and a storage cartridge according to the second aspect is suggested, wherein the dosing device is attached to the storage cartridge.

When in use, for example in a dishwasher or a washing machine, the dosing unit may comprise any combination of one of the embodiments of the dosing device and one of the embodiments of the storage cartridge.

According to a fourth aspect of the invention, a method for dosing a detergent tablet provided by a storage cartridge is suggested. In a first step, a dosing device is attached to the storage cartridge to form a dosing unit. In a second step, the dosing unit is rotated in a first turning direction about a rotational axis that is perpendicular to a gravitational vector such that a scoop of the dosing device picks up a detergent tablet from the storage cartridge, lifts the detergent tablet to an opening in the scoop and transports the detergent tablet to a receiving chamber formed in a plug of the dosing device. Depending on the implementation of the dosing unit, a certain degree of rotation, for example one or several full rotations, may be necessary to ensure that a detergent tablet reaches the receiving chamber. In a third step, the plug is actuated for releasing the detergent tablet stored in the receiving chamber for dosing the detergent tablet.

Preferably, this method is performed using the dosing device according to the first aspect and the storage cartridge according to the second aspect. Further, the method is preferably performed using the dosing unit according to the third aspect.

The step of attaching the dosing device to the storage cartridge may be performed in a factory as a step during manufacture of the dosing unit. It may also be performed by a user of a water-bearing household appliance for which the dosing unit is designed, before placing the dosing unit in a dosing system of the water-bearing household appliance.

In an embodiment, the method further comprises a step of rotating the dosing unit when the plug is in an open position, such that detergent tablets are dosed without being stored in the receiving chamber. Preferably, dosing occurs one by one, that is, it is possible to precisely dose a predefined number of detergent tablets in this step. For example, when the plug is actuated for releasing the detergent tablet, it is moved from a closed position to the open position. The plug is then kept in the open position and the dosing unit is rotated. For example, for each predefined degree of rotation, one detergent tablet can be dosed. Then, the dosing unit may be rotated as many times this degree of rotation until a predefined number of detergent tablets are dosed.

In a further embodiment, the method comprises a step of moving the plug from the open position to an intermediate position close to the closed position and then rotating the dosing unit such that the scoop of the dosing device picks up a detergent tablet from the storage cartridge, lifts the detergent tablet to the opening in the scoop and transports the detergent tablet to the receiving chamber formed in the plug of the dosing device. When the plug is in the intermediate position, the dosing device may not be securely sealed by a sealing element configured for sealing the dosing device when the plug is in the closed position, but a space formed between the receiving chamber and the scoop can only hold exactly one detergent tablet. That is, the effect of the limited space of the receiving chamber is still achieved in the intermediate position, which is that dosing of two detergent tablets is suppressed when the receiving chamber (and the scoop) are designed for dosing one by one detergent tablet. The plug may then be moved to the open position in order to release the one detergent tablet and the process may be repeated until the predetermined number of detergent tablets has been released. In this embodiment, a torque necessary for turning the plug for moving from the intermediate position to the open position may be reduced compared with turning the plug from the closed position. Therefore, dosing of a predefined number of detergent tablets is achieved in reliable and fast way.

In a further embodiment, the method further comprises a step of partially opening the plug of the dosing device and turning the dosing unit for one or several times may be performed in order to eject detergent powder generated during transportation of the dosing unit that may have accumulated in the receiving chamber of the plug and/or on the scoop. Preferably, this step is performed before normal dosing operation.

In a further embodiment, the method further comprises a step of rotating the dosing unit about the rotational axis in a second turning direction opposite the first turning direction. By this, detergent tablets stored in the storage cartridge may be conveyed away from the scoop. This may be beneficial, since a contamination of the storage cartridge, in particular by humidity, can enter the storage cartridge only via the dosing device, and by displacing the detergent tablets away from the affected area, an effect on the detergent tablets can be reduced. Further, certain embodiments of the dosing unit or the dosing device may be operated by a swiveling movement.

According to a fifth aspect of the invention, a water-bearing household appliance, in particular a dishwasher or a washing machine, with an automatic dosing system for automatically dosing a detergent tablet provided by a storage cartridge for storing a plurality of detergent tablets into washing liquor for washing articles is suggested. The water-bearing household appliance comprises a receiving portion for receiving the storage cartridge and a driving unit for actuating a dosing device that is attachable to the storage cartridge for dosing the detergent tablet. The dosing device is configured according to the first aspect of the invention and the storage cartridge is configured according to the second aspect of the invention.

This water-bearing household appliance has the advantage that multiple washing cycles can be performed without the need that a user fills the detergent for each cycle. Further, a proper amount of detergent can automatically be provided, that is, when articles, such as dishes or clothes, are relatively clean, a small amount may be sufficient, for example a single detergent tablet, and when articles are relatively dirty, a larger amount may be necessary for obtaining a good cleaning result, for example three detergent tablets. Also, timings for dosing detergent tablets may be varied in order to improve a cleaning result. This can be convenient for a user. When the storage cartridge runs out of detergent tablets, the user can simply refill or replace the storage cartridge or the whole dosing unit. Here, the term dosing unit denotes the storage cartridge with attached dosing device.

All embodiments of the dosing device according to the first aspect and all embodiments of the storage cartridge according to the second aspect can be used in conjunction with the automatic dosing system of the water-bearing household appliance. Furthermore, all explanations and definitions provided corresponding to any of the first through fourth aspects of the invention apply to the fifth aspect as well.

The automatic dosing system, in particular the receiving portion, is arranged in the water-bearing household appliance such that the dosing unit will be held in the proper orientation as described before, which is an essentially horizontal orientation.

The automatic dosing system may comprise further elements, such as a dosing channel, which collect the detergent tablet when they fall out of the outlet and guide them to a desired position in the water-bearing household appliance.

The automatic dosing system may be implemented such that it can be operated by a controller that generally controls the various functions of the water-bearing household appliance, in particular when an automatic washing process or washing cycle is performed.

In embodiments, the dosing device is arranged in the automatic dosing system and the driving unit is configured to attach the dosing device to and/or to detach the dosing device from the storage cartridge.

For example, the automatic dosing system comprises a dosing device that is attachable to the storage cartridge. For example, the dosing device is arranged in the automatic dosing system, and when the storage cartridge is placed in the receiving portion, the driving unit drives and attaches the dosing device on the storage cartridge, thus forming a dosing unit that is implemented for dosing detergent tablets from the storage cartridge to the washing liquor.

In embodiments, the receiving portion of the automatic dosing system is configured for receiving the dosing unit comprising the dosing device attached to the storage cartridge. This embodiment has the advantage the dosing device is replaced each time when the storage cartridge is replaced, such that a wear of the dosing device that might occur after several dosing repetitions won't become critical. That is, a blocking or failure of the dosing device or the dosing unit due to wear is prevented.

According to a further embodiment, a dosing unit comprising the dosing device attached to the storage cartridge is arranged in the receiving portion.

In this embodiment, the receiving portion is configured for accepting a pre-assembled dosing unit, where the dosing device is attached to the storage cartridge externally, for example by the user or manufacturer of the dosing unit.

According to a sixth aspect of the invention, a method for operating a water-bearing household appliance, particularly a dishwasher or washing machine, is suggested. The water-bearing household appliance comprises an automatic dosing system for automatically dosing a detergent tablet provided by a storage cartridge for storing a plurality of detergent tablets into washing liquor for washing articles. The automatic dosing system comprises a receiving portion for receiving the storage cartridge and a driving unit for actuating a dosing device that is attachable to the storage cartridge for dosing the detergent tablet. In a first step, a dosing device is attached to the storage cartridge to form a dosing unit. According to a second step, driving means of the driving unit are engaged with the dosing unit. According to a third step, the dosing unit is rotated in a first turning direction about a rotational axis that is perpendicular to a gravitational vector by the driving means such that a scoop of the dosing device picks up a detergent tablet from the storage cartridge, lifts the detergent tablet to an opening in the scoop and transports the detergent tablet to a receiving chamber formed in a plug of the dosing device. Depending on the implementation of the dosing unit, a certain degree of rotation, for example one or several full rotations, may be necessary to ensure that a detergent tablet reaches the receiving chamber. According to a fourth step, the plug for releasing the detergent tablet stored in the receiving chamber is actuated for dosing the detergent tablet into the washing liquor.

This method is preferably performed with a water-bearing household appliance according to the fifth aspect. The method may comprise further steps and/or the steps may be followed in an order different than presented here.

All embodiments of the method for dosing a detergent tablet according to the fourth aspect are also embodiments of the suggested method according to the sixth aspect.

Particularly, a step of partially opening the plug of the dosing device and turning the dosing unit for one or several times may be performed each time a new dosing unit is placed in the receiving portion, in order to eject detergent powder generated during transportation of the dosing unit that may have accumulated in the receiving chamber of the plug and/or on the scoop. Preferably, this is performed before normal operation of the water-bearing household appliance, when the environment is still dry. This step can avoid that detergent powder becomes wet and sticks to the sealing portion and/or movable parts, which might lead to blocking these parts.

The invention has been described in terms of different embodiments. It is to be understood that one or more features of any one embodiment may be combinable with one or more features of the other embodiments. In addition, any single feature or combination of features in any of the embodiments may constitute additional embodiments.

Further embodiments or aspects of the invention are subject to the depending claims and the examples which are described in the following with reference to the figures.

Figure 2:
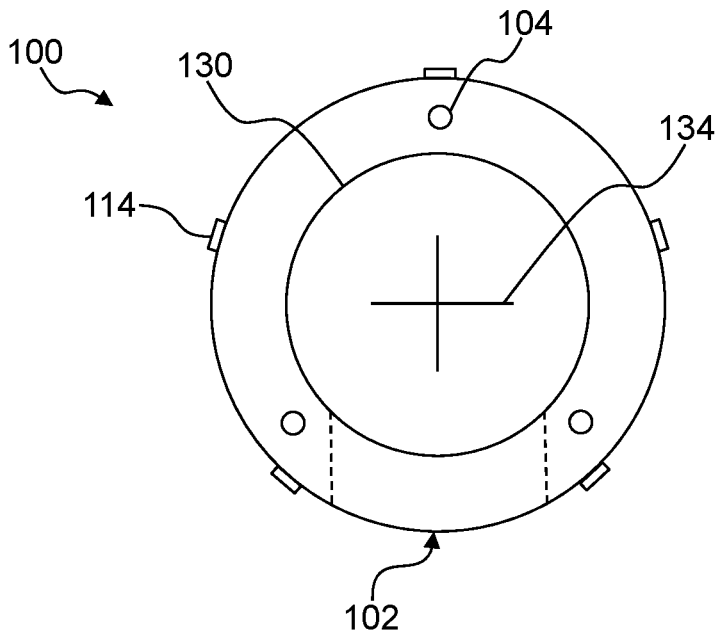
FIG. 2 shows a schematic front view of an example of a dosing device.
Figure 3:
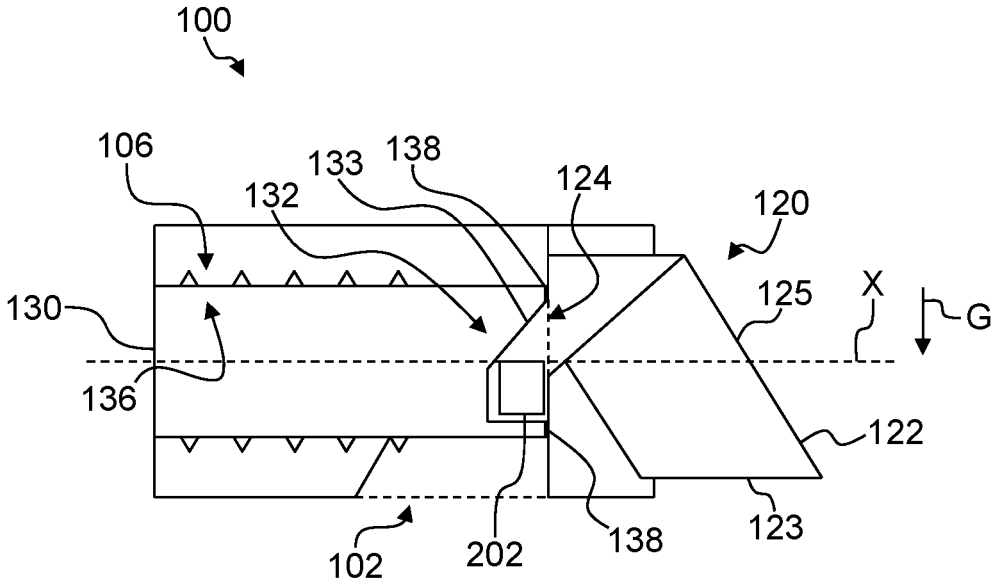
FIG. 3 shows a schematic sectional view of an example of a dosing device in a first state.
Figure 4:
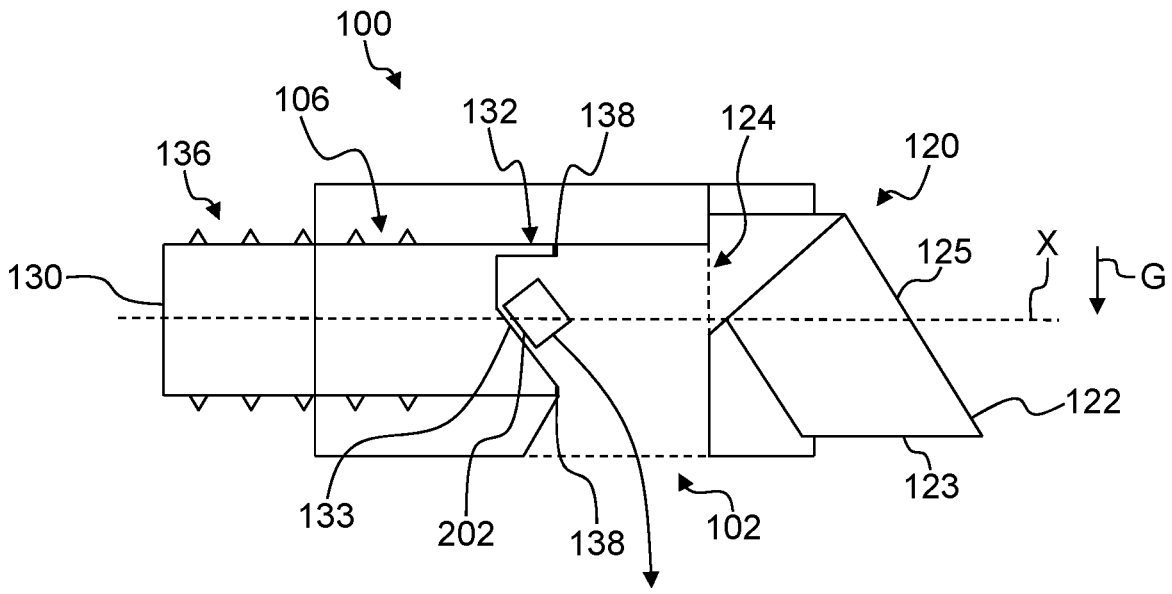
FIG. 4 shows a schematic sectional view of an example of a dosing device in a second state.
Figure 5:
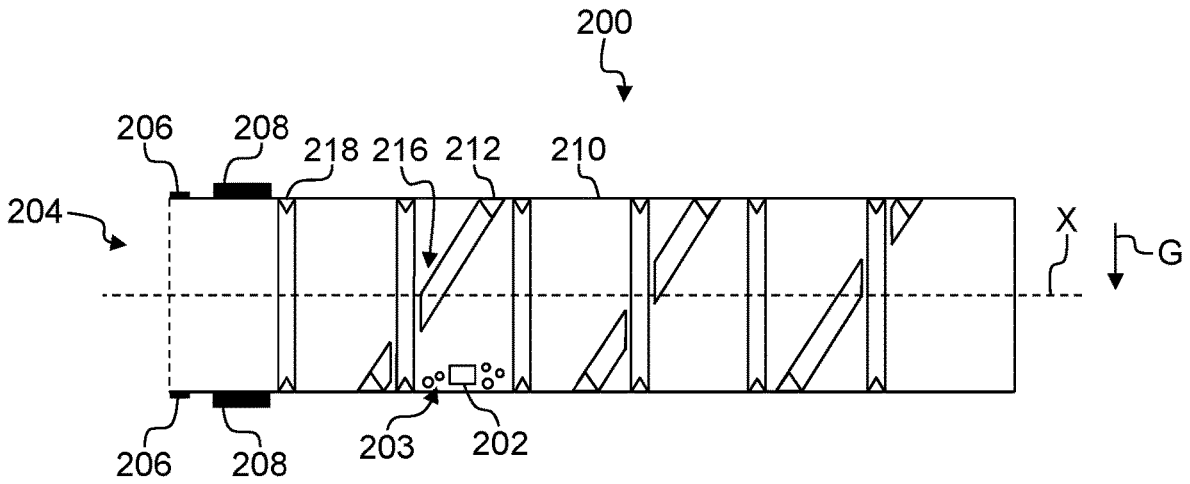
FIG. 5 shows a schematic sectional view of an example of a storage cartridge.
Figure 6:
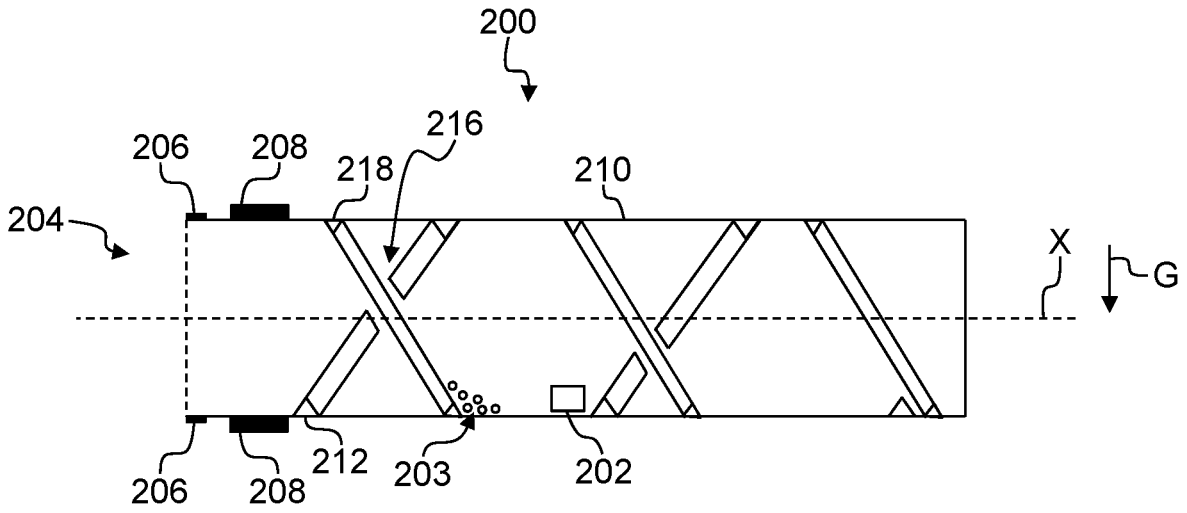
FIG. 6 shows a schematic sectional view of a further example of a storage cartridge.
Figure 7:
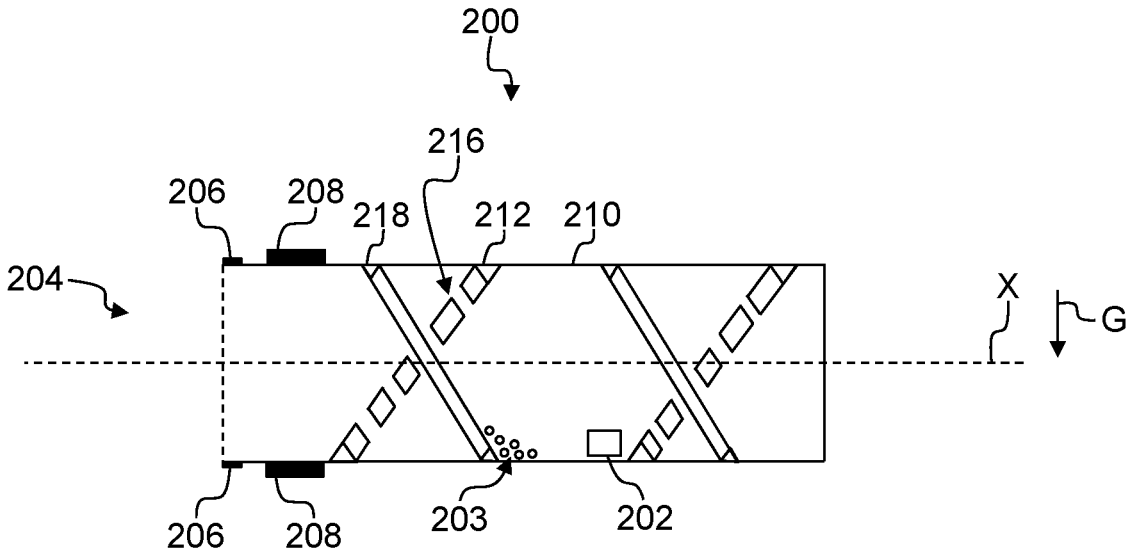
FIG. 7 shows a schematic sectional view of a further example of a storage cartridge.
Figure 8:
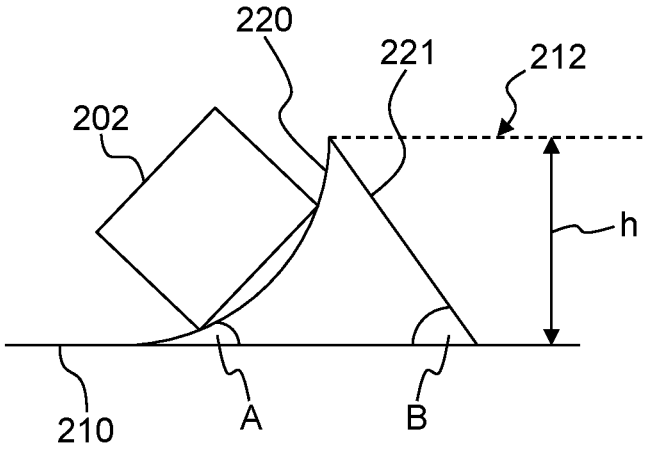
FIG. 8 shows a schematic sectional view of an example of a helical indent.
Figure 9:
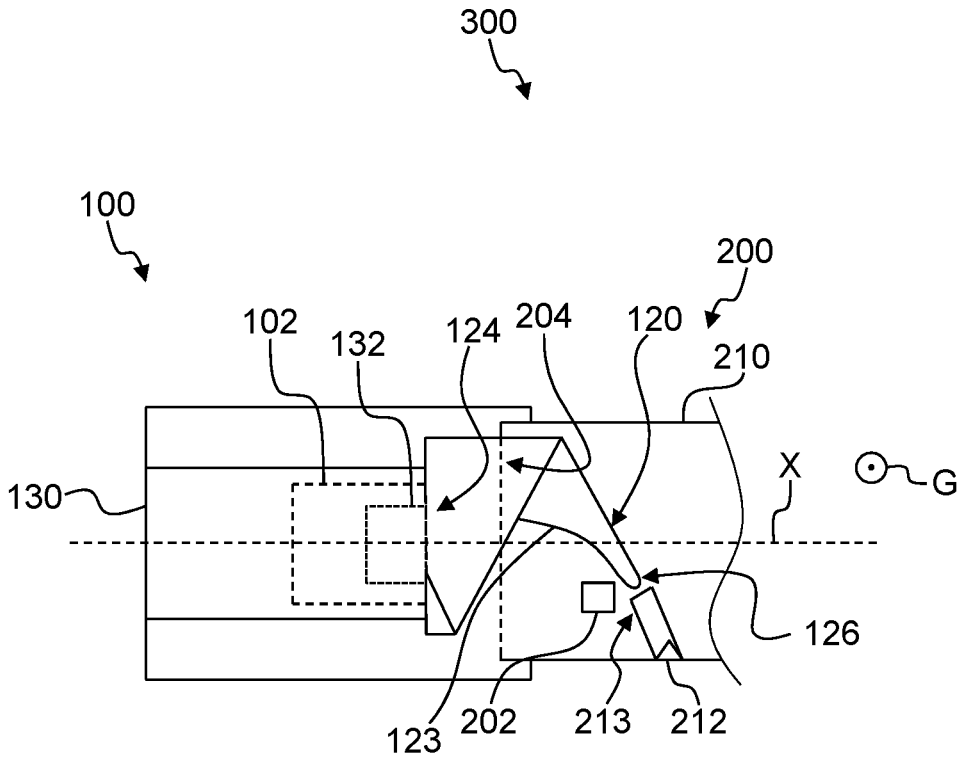
FIG. 9 shows a schematic sectional view of a further example of a dosing unit.
Figure 10:
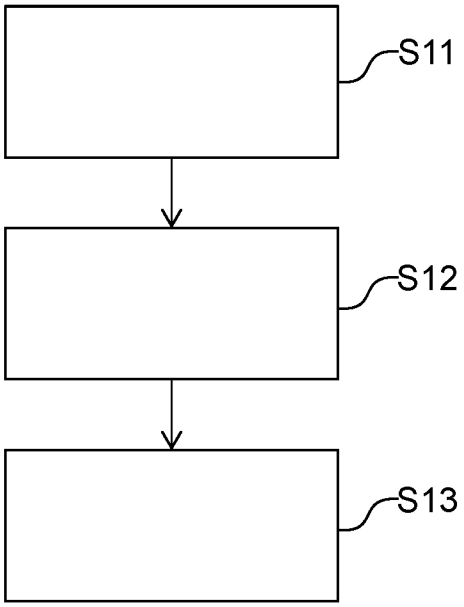
FIG. 10 shows a schematic block diagram of an example of a method for dosing a detergent tablet.
Figure 11:
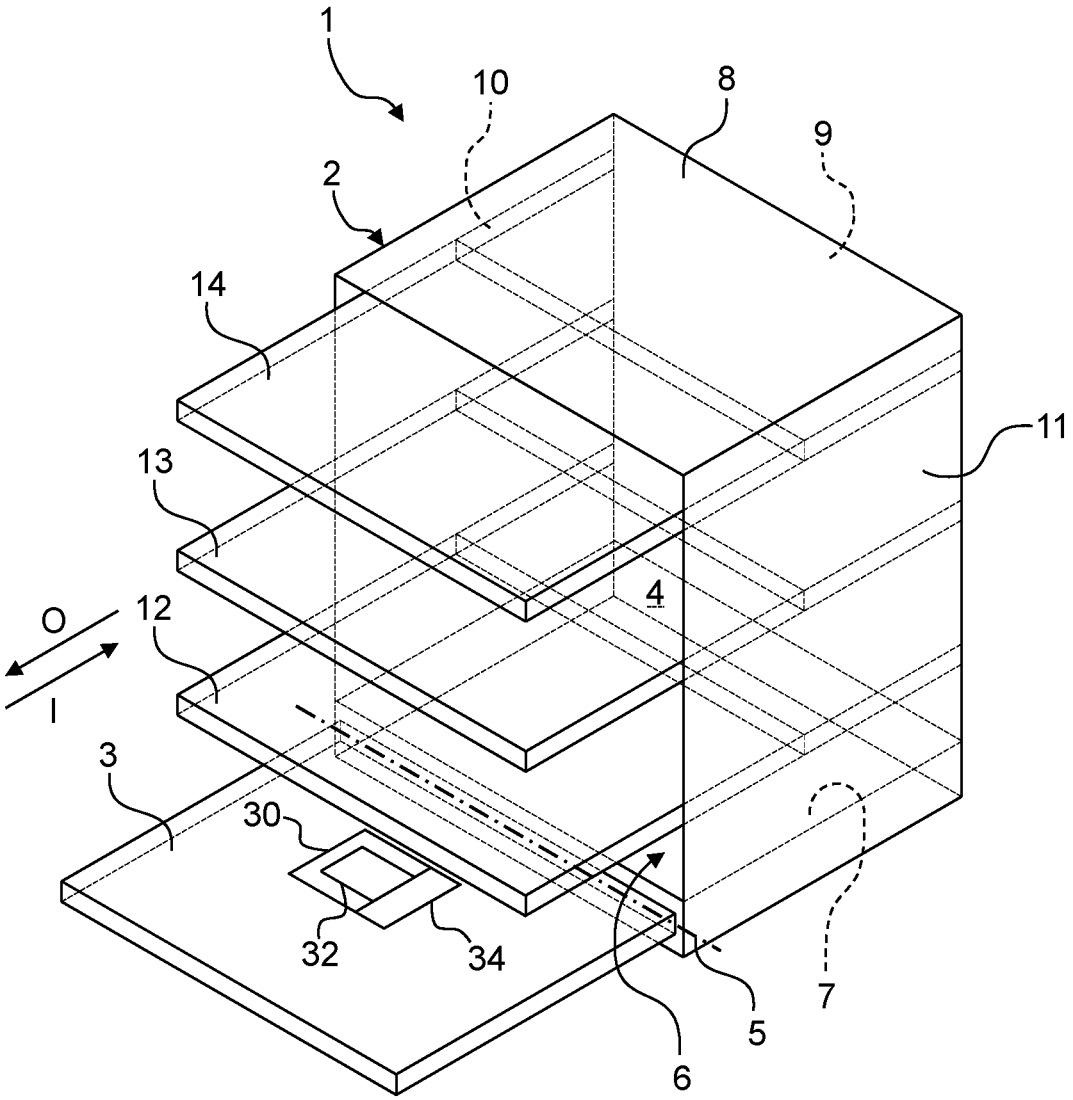
FIG. 11 shows a schematic perspective view of an example of a water-bearing household appliance.
Figure 12:
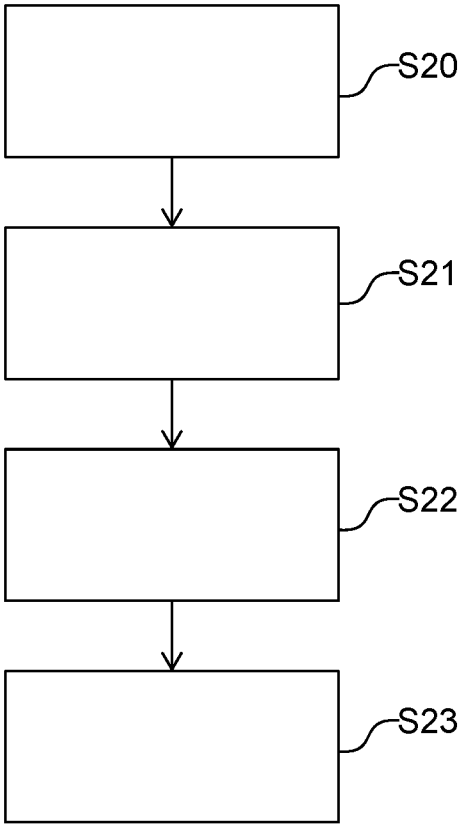
FIG. 12 shows a schematic block diagram of an example of a method for operating a water-bearing household appliance.

FIG. 1 shows a schematic sectional view of a first example of a dosing unit;

FIG. 2 shows a schematic front view of an example of a dosing device;

FIG. 3 shows a schematic sectional view of an example of a dosing device in a first state;

FIG. 4 shows a schematic sectional view of an example of a dosing device in a second state;

FIG. 5 shows a schematic sectional view of an example of a storage cartridge;

FIG. 6 shows a schematic sectional view of a further example of a storage cartridge;

FIG. 7 shows a schematic sectional view of a further example of a storage cartridge;

FIG. 8 shows a schematic sectional view of an example of a helical indent;

FIG. 9 shows a schematic sectional view of a further example of a dosing unit;

FIG. 10 shows a schematic block diagram of an example of a method for dosing a detergent tablet;

FIG. 11 shows a schematic perspective view of an example of a water-bearing household appliance; and FIG. 12 shows a schematic block diagram of an example of a method for operating a water-bearing household appliance.

In the figures, like elements are denoted with the same reference numerals unless otherwise indicated.

FIG. 1 shows a schematic sectional view of a first example of a dosing unit 300 comprising a dosing device 100 and a storage cartridge 200. The dosing device 100 is attached to the storage cartridge 200. The dosing unit 300 is arranged such that a rotational axis X is perpendicular to a gravitational vector G, or essentially perpendicular to the gravitational vector G. For example, an angle between the rotational axis X of dosing unit 300 and the gravitational vector G may have a value between 45°-135°.

The storage cartridge 200 comprises a container 210 which has a cylindrical shape and extends along the rotational axis X. The container 210 may be filled with detergent tablets 202. For maintaining a clear view, only a view detergent tablets are shown in FIG. 1. On one face of the cylindrical container 210 there is an opening 204. On an inner surface of the container 210, a first helical indent 212 is formed. In this example, the helical indent 212 is continuous throughout the container 210 and has a constant height, pitch, gradient and flank angle. In further embodiments, the helical indent 212 may have variable properties along its extension. The helical indent 212 provides conveyance of detergent tablets 202 when the storage cartridge 200 is turned about the rotational axis X, wherein the direction of conveyance depends on the turning direction.

The dosing device 100 is attached non-rotatably to the storage cartridge 200 on the side of the opening 204 of the container 210. The dosing device 100 comprises a sealing portion 110 that engages with a corresponding sealing portion 206 of the storage cartridge 200, which provides a circumferential seal between the dosing device 100 and the storage cartridge 200, so that the inner volume of the container 210 is sealed from the environment.

The dosing device 100 comprises a scoop 120 and a plug 130. A sealing element (not shown) may be arranged between the scoop 120 and the plug 130. The scoop 120 protrudes through the opening 204 into the inner volume of the container 210. The scoop 120 comprises a pick-up portion 122, that is implemented as spirally curved plane. An opening 124 is formed in a central part of the scoop 120 facing away from the storage cartridge 200. The central opening 124 allows detergent tablets 202, that are picked-up, lifted and transported by the scoop 120 to enter a receiving chamber 132 that is formed in the plug 130. A lip 108 is formed at the opening 124 in order to retain detergent tablets 202 in the receiving chamber 132. On one side, an outlet 102 is formed in the dosing device 100, which is shown as facing down in FIG. 1. The outlet 102 allows detergent tablets 202 stored in the receiving chamber 132 of the plug 130 to fall out and exit the dosing device 100, as soon as the plug 130 clear the outlet 102, for example by being retracted in a direction away from the scoop 120 (see FIGS. 3 and 4).

By turning the dosing unit 300 about the rotational axis X clockwise when viewed along the axis X from the dosing device 100 towards the storage cartridge 200, the detergent tablets 202 in the container 210 are conveyed towards the opening 204 by the first helical indent 212. When a detergent tablet 202 reaches the front end of the container 210, where the scoop 120 protrudes into the container 210, it may be picked up by the pick-up portion 122 of the scoop 120. For example, the pick-up portion 122 is implemented such that a leading edge 123 is close to or even in contact with the inner surface of the container 210. This ensures that the detergent tablet 202 can be picked up by the pick-up portion 122, when it is in the effective range of the pick-up portion 122. As is shown in FIG. 1, a detergent tablet 202 is already picked up by the pick-up portion 122. By further turning the dosing unit 300, which also turns the scoop 120, the detergent tablet 202 will slide on the pick-up portion 122 due to gravitational force, but simultaneously be lifted and transported towards the central opening 124 due to the spiral form of the pick-up portion 122. For example, a retainer (not shown) is formed at a trailing edge 125 (see FIGS. 3 and 4) of the pick-up portion 122 to ensure that the detergent tablet 202 does not easily fall off the pickup portion 122 when the assembly is rotated. The shape of the scoop 120 ensures that the detergent tablet 202 is transported to the central opening 124 and will fall into the receiving chamber 132 from there.

The receiving chamber 132 is specifically designed such that a predetermined number of detergent tablets 202 can be stored in it. The precise design parameters depend on the shape and geometry of the detergent tablets 202. For example, in order to be able to precisely dose individual detergent tablets 202 each time the dosing unit 300 is employed, the receiving chamber 132 has a volume that is only slightly larger than that of a single detergent tablet 202. Then, when a detergent tablet 202 is stored in the receiving chamber 132 and a second detergent tablet 202 is transported by the scoop 120 to the opening 124, the second detergent tablet 202 cannot enter the receiving chamber 132, because it is occupied.

For example, the dosing unit 300 will be rotated 3 times, that is, by 1080°, each time the receiving chamber 132 shall be filled with a detergent tablet 202. In further embodiments, the receiving chamber 132 may have a different geometry and may take up more than one detergent tablet 202. Then, by rotating the dosing unit 300 several times, the receiving chamber 132 may be filled with several detergent tablets 202, as is desired.

FIG. 2 shows a schematic front view of an example of a dosing device 100. As can be seen, the dosing device 100 in this example has a circular cross-section. Five connection means 114 are arranged on a circumference of the dosing device 100 on the side that will be attached to the storage cartridge 200 (see FIG. 1). The connection means 114 are, for example, implemented as snap-fit connectors that allow a one-time fit and are not easily released. The connectors 114 are arranged such that attachment is only possible in a predefined relative angular position. Concerning the dosing device 100, the outlet 102 defines a preferred direction, according to which the connectors 114 are arranged, because the outlet 102 needs to be facing down with respect to a gravitational vector so that the detergent tablets 202 call exit through the outlet 102. Concerning the storage cartridge 200, an end-point 213 (see FIG. 7) of the first helical indent 212 defines a preferred direction.

On a front face of the dosing device 100, three engagement means 104 are formed. These engagement means 104 are here formed as simple recesses. The recesses 104 are suitable for transferring a torque onto the dosing device 100 for turning the dosing device 100. Specifically, the engagement means 104 are configured for engagement with a driving device of an external driving unit (not shown) for turning or holding the dosing device 100 and the storage cartridge 200, when the dosing device 100 is securely fastened to the storage cartridge 200 to form a dosing unit 300 (see FIG. 1).

On a front face of the plug 130, which has a cylindrical form, an engaging section 134 for engagement with a driving element of an external driving unit (not shown) is arranged. The engaging section 134 is configured for transferring a torque onto the plug 130 for turning the plug 130. In this example, the engaging section 134 is formed as a cross recess that can engage with a crossed screwdriver, for example. Particularly, when the dosing device 100 is held fixed by the driving device and the plug 130 is turned by the driving element, the plug 130 is moved relative to the dosing device 100.

In the following, an example of a procedure for releasing the detergent tablet 202 from the receiving chamber 132 will be explained referring to FIGS. 3 and 4. FIGS. 3 and 4 show a further example of a dosing device 100, which has generally the same or similar features as the examples shown in FIG. 1 and/or FIG. 2. Although a storage cartridge 200 is not shown in FIG. 3 or 4, it is clear that the dosing device 100 is arranged for attachment to a storage cartridge 200 as explained before.

In this example, the plug 130 has a cylindrical form and has an outer thread 136 on the cylindrical outer face. The dosing device 100 accommodates the plug 130 and provides an inner thread 106, which engages with the outer thread 136 of the plug 130, such that when the plug 130 is turned relative dosing device 100 about the axis X, the plug 130 will move forward or backward relative to the dosing device 100, which allows the plug 130 to be changed between a closed position and a release position.

FIG. 3 shows the plug 130 in the closed position. It can also be said that the dosing device 100 is in a closed state. In this state, a sealing portion 138 that is arranged on the plug 130 is in close contact with a corresponding section of the scoop 120, for example, providing a seal between the outlet 102 and the receiving chamber 132. For example, the sealing portion 138 comprises a gasket. By this, when the dosing device 100 is attached to a storage cartridge 200, the inner volume of the container of the storage cartridge 200 will be sealed from the environment when the dosing device 100 is in the closed state. Preferably, the seal is impermeable to fluids of all kinds.

Assume, that a detergent tablet 202 is stored in the receiving chamber 132 of the plug 130. For example, the detergent tablet 202 was picked up, lifted and transported by the pick-up portion 122 of the scoop 120 to the opening 124 and then entered the receiving chamber 132 by turning the dosing device 100. For example, the dosing device 100 was turned by a driving device of an external driving unit (not shown), as was explained referring to FIG. 2.

For releasing the detergent tablet 202 from the receiving chamber 132, the plug 130 needs to be moved into the release position. This is achieved by holding the dosing device 100 fixed, for example by locking the driving device in the position as shown. Then, a driving element of the external drive unit that is engaged with the engaging section 134 of the plug (see FIG. 2) may be turned, such that the plug 130 is turned relative to the dosing device 100. By this, the plug 130 is moved into the release position, which is shown in FIG. 4. It can also be said that the dosing device 100 is in an open state. As is indicated in FIG. 4, the detergent tablet 202 stored in the receiving chamber 132 is agitated by the inclined plane 133 that is formed in the receiving chamber 132 and falls out of the receiving chamber 132, via the outlet 102 of the dosing device 100. After this, the plug 130 will be relocated into the closed position, so that the receiving chamber 132 can be refilled with a detergent tablet 202.

FIGS. 5 to 7 show schematic sectional views of different examples of a storage cartridge 200. In these examples, a second helical indent 218 is formed on the inside of the cylindrical container 210. The purpose of the second helical indent 218 is to retain detergent powder 203 in the storage container 200. This is achieved by configuring the second helical indent 218 such that the larger detergent tablets 202 will be conveyed by the first helical indent 212 even over the second helical indent 218, while the second helical indent 218 does not convey the detergent powder 203 or convey the detergent powder 203 in the opposite direction. At the side of the opening 124, the storage cartridges 200 shown in these examples have both a sealing portion 206 as well as connection means 208, which correspond to connection means 114 arranged on the dosing device 100 (see FIG. 2).

In FIG. 5, for example, the second helical indent 218 comprises a plurality of rings. At positions, at which the first helical indent 212 crosses the rings 218, the first helical indent 212 has a discontinuity 216, which allows detergent powder 203 to pass through, while the larger detergent tablet 202 will be pushed over the ring 218 by the first helical indent 212. The first helical indent 212 may have a specific form at the discontinuity 216 to ensure transport of the detergent tablets 202 over the second helical indent 218, such as a larger height and/or flanking angle than in between two discontinuities 216.

In FIG. 6, for example, the second helical indent 218 is formed in the opposite direction than the first helical indent 212. Therefore, detergent powder 203 is conveyed oppositely than detergent tablets 202. Similarly, in this example the first helical indent 212 has discontinuities 216 at positions where the first helical indent 212 and the second helical indent 218 cross.

In FIG. 7, for example, the first helical indent 212 comprises a plurality of sections, wherein between each two successive sections there is a discontinuity 216 that allows detergent powder 203 to pass through. The sections are designed so that detergent tablets 202 are still securely conveyed. Additionally, a second helical indent 218 is formed that conveys the detergent powder 203 in the opposite direction than the first helical indent 212 conveys the detergent tablets 202.

FIG. 8 shows a schematic sectional view of an example of a first helical indent 212. Specifically, the first helical indent 212 may be defined by a certain height h, a certain flank angle A between a front side 220 and a base of the helical indent 212, a certain flank angle B between a rear side 221 and the base of the helical indent 212, and the geometric form of the front side 220 and the rear side 221. In this example, the front side 220 is the side that is intended for pushing detergent tablets 202 forward. Therefore, the front side 220 has a special shape, which is a curved shape in this example. The rear side 221, on the other hand, is a simple straight line in this example. The geometry of the first helical indent 212 may be optimized as a function of the geometry and size of the detergent tablets 202.

FIG. 9 shows a schematic sectional view of a further example of a dosing unit 300 comprising a dosing device 100 and a storage cartridge 200. The dosing device 100 and the storage cartridge 200 may generally have all features that were described before, even if not mentioned explicitly hereafter.

In this example, the dosing unit 300 is shown from a top view, that is, the gravitational vector G is pointing into the projection plane. In this example, the predefined angular position between the dosing device 100 and the storage cartridge 200, which is ensured by the specific arrangement of the connection means 114, 208 (see FIGS. 2 and 5 to 7), is explained. As discussed before, the outlet 102 of the dosing device 100 can be used to define a preferred direction. Further, the scoop 120 has a predefined arrangement, specifically, the scoop 120 is fixed relative to the outlet 102. Concerning the storage cartridge 200, the end-point 213 of the first helical indent 212 may be used for defining a preferred direction. The connection means 114, 208 are arranged such that the dosing device 100 must be fixed on the storage cartridge 200 in the position as shown in FIG. 9. Then, a leading edge 123 of the pick-up portion 122 of the scoop 120 corresponds with the end-point 213 of the first helical indent 212. This ensures that detergent tablets 202 are conveyed until the effective range of the scoop 120. Therefore, a dosing performance of the dosing unit 300 is significantly increased. In this example, the leading edge 123 of the pick-up portion 122 is slightly curved, so that a detergent tablet 202 is not pushed away from the scoop 120, but is trapped in the effective range of the scoop 120. Further, the tip of pick-up portion 122 is formed as a tooth 126, which is designed such that a detergent tablet 202 that is not yet fully in the effective range of the scoop 120 will be collected.

FIG. 10 shows a schematic block diagram of an example of a method for dosing a detergent tablet 202 (see FIG. 1 or 3-9). The detergent tablet 202 is provided by a storage cartridge 200 (see FIGS. 1, 5 to 7, and 9). In a first step S11, a dosing device 100 (see FIGS. 1 to 4 and 9) is attached to the storage cartridge 200, forming a dosing unit 300 (see FIG. 1 or 9). In a second step S12, the dosing unit 300 is rotated in a first turning direction about a rotational axis X (see FIG. 1 or 3-9) that is perpendicular to a gravitational vector G (see FIG. 1, 3-7 or 9) such that a scoop 120 (see FIG. 1, 3, 4 or 9) of the dosing device 100 picks up a detergent tablet 202 from the storage cartridge 200, lifts the detergent tablet 202 to an opening 124 (see FIG. 1, 3, 4 or 9) in the scoop 120 and transports the detergent tablet 202 to a receiving chamber 132 (see FIG. 1, 3, 4 or 9) formed in a plug 130 (see FIG. 1-4 or 9) of the dosing device 100. In a third step S13, the plug 130 is actuated for releasing the detergent tablet 202 stored in the receiving chamber 132 for dosing the detergent tablet 202.

FIG. 11 shows a schematic perspective view of an example of a water-bearing household appliance 1, which is implemented as a domestic dishwasher. The domestic dishwasher 1 comprises a tub 2, which can be closed by a door 3. Preferably, the door 3 seals the tub 2 so that it is waterproof, for example by using a door seal between door 3 and the tub 2. Preferably, the tub 2 has a cuboid shape. Tub 2 and door 3 can form a washing chamber 4 for washing dishes.

In FIG. 11, door 3 is shown in the open position. By swiveling about an axis 5 at a lower edge of door 3, the door 3 can be opened or closed. With the door 3, an opening 6 of the tub 2 for inserting dishes into the washing chamber 4 can be opened or closed. Tub 2 comprises a lower cover 7, an upper cover 8 facing the lower cover 7, a rear cover 9 facing the closed door 3 and two side covers 10, 11 which face each other. For example, the lower cover 7, the upper cover 8, the rear cover 9 and the two side covers 10, 11 can be made from stainless steel sheets. Alternatively, at least one of the covers, for example the lower cover 7, can be made from a polymeric material, such as plastic.

The domestic dishwasher 1 further has at least one rack 12, 13, 14 on which dishes to be washed can be placed. Preferably, more than one rack 12, 13, 14 is used, wherein rack 12 can be lower rack, rack 13 can be an upper rack and rack 14 can be a rack specific for cutlery. As is shown in FIG. 1, the racks 12 to 14 are arranged vertically above each other in the tub 2. Each rack 12, 13, 14 can be pulled out from the tub 2 in a first direction O or pushed into the tub 2 in a second direction I.

FIG. 11 further shows an automatic dosing system 30 that is arranged in the door 3 of the domestic dishwasher 1. The automatic dosing system 30 comprises a receiving portion 32 that is arranged to accept a storage cartridge 200 (see FIG. 1, 5-7 or 9) and/or a dosing unit 300 (see FIG. 1 or 9). Further, the automatic dosing system 30 has a driving unit 34 configured to drive the dosing unit 300 for automatically dosing a detergent tablet 202 stored in the storage cartridge 200.

The receiving portion 32 is arranged such that the orientation of the dosing unit 300 comprising dosing device 100 (see FIG. 1-4 or 9) and storage cartridge 200 that is received by the receiving portion 32 relative to a gravitational vector G (see FIG. 1, 3-7 or 9) is as shown in FIGS. 1-9 when the door 3 is in the closed position and the water-bearing household appliance 1 is set up as intended for use. The receiving portion 32 may comprise a receiving chamber (not shown) for installing the dosing unit 300 or storage cartridge 200 and which may be accessed by a door (not shown), separating it from the washing chamber 4.

The driving unit 34 preferably comprises driving means (not shown) for engaging with engagement means 104 formed in the dosing device 100 or with an engaging section 134 formed in the plug 130 (see FIG. 2).

It is possible that the automatic dosing system 30 comprises a dosing device 100 that is attachable to the storage cartridge 200. For example, the dosing device 100 is arranged in the automatic dosing system 30 and when the storage cartridge 200 is placed in the receiving portion 32, the driving unit 34 drives and attaches the dosing device 100 on the storage cartridge 200, thus forming a dosing unit 300 that is implemented for dosing detergent tablets 202. Additionally or alternatively, the receiving portion 32 can be configured for accepting a pre-assembled dosing unit 300, where the dosing device 100 is attached to the storage cartridge 200 externally, for example by the user or already in the factory. All examples of dosing devices 100, storage cartridges 200 and/or dosing units 300 described above with reference to FIGS. 1-9 can be used in conjunction with the automatic dosing system 30 of the water-bearing household appliance 1, which is preferably implemented as a domestic dishwasher or washing machine.

FIG. 12 shows a schematic block diagram of an example of a method for operating a water-bearing household appliance 1, for example the domestic dishwasher shown in FIG. 1. The water-bearing household appliance 1 has an automatic dosing system 30 for automatically dosing a detergent tablet 202 (see FIG. 1 or 3-9) stored in a storage cartridge 200 (see FIGS. 1, 5 to 7, and 9) for storing a plurality of detergent tablets 202 into washing liquor for washing articles. The automatic dosing system 30 comprises a receiving portion 32 for removably receiving the storage cartridge 200 and a driving unit 34 for actuating a dosing device 100 (see FIG. 1-4 or 9) that is attachable to the storage cartridge 200 for dosing the detergent tablet 202. In a first step S20, the dosing device 100 is attached to the storage cartridge 200, forming a dosing unit 300 (see FIG. 1 or 9). In a second step S21, driving means of the driving unit 34 are engaged with a dosing unit 300 comprising the storage cartridge 200 with attached dosing device 100. In a third step S22, the dosing unit 300 is rotated in a first turning direction about a rotational axis X (see FIG. 1 or 3-9) that is perpendicular to a gravitational vector G (see FIG. 1, 3-7 or 9) by the driving means, such that a scoop 120 (see FIG. 1, 3, 4 or 9) of the dosing device 100 picks up a detergent tablet 202 from the storage cartridge 200, lifts the detergent tablet 202 to an opening 124 (see FIG. 1, 3, 4 or 9) in the scoop 120 and transports the detergent tablet 202 to a receiving chamber 132 (see FIG. 1, 3, 4 or 9) formed in a plug 130 (see FIG. 1-4 or 9) of the dosing device 100. In a fourth step S23, the plug 130 is actuated by the driving means for releasing the detergent tablet 202 stored in the receiving chamber 132 for dosing the detergent tablet 202 into the washing liquor.

While the present technology has been described in connection with several practical examples, it is to be understood that the technology is not to be limited to the disclosed examples, but on the contrary, is intended to cover various modifications and equivalent arrangements included within the spirit and scope of the technology.

REFERENCE NUMERALS

1 Water-bearing household appliance
2 Tub
3 Door
4 Washing chamber
5 Axis
6 Opening
7 Lower cover
8 Top cover
9 Rear cover
10 Side cover
11 Side cover
12 Rack
13 Rack
14 Rack
30 Automatic dosing system
32 Receiving portion
34 Driving unit
100 Dosing device
102 Outlet
104 Engagement means
106 Thread
108 Lip
110 Sealing portion
114 Connection means
120 Scoop
122 Pick-up portion
123 Leading edge
124 Opening
125 Trailing edge
126 Tooth
130 Plug
132 Receiving chamber
133 Inclined plane
134 Engaging section
136 Thread
138 Sealing portion
200 Storage cartridge
202 Detergent tablet
203 Detergent powder
204 Opening
206 Sealing portion
208 Connection means
210 Container
212 First helical indent
213 End-point
216 Discontinuity
218 Second helical indent
220 Front side
221 Rear side
A Angle
B Angle
G Gravitational vector
h Height
I Push-in direction
O Pull-out direction
S11 Method step
S12 Method step
S13 Method step
S20 Method step
S21 Method step
S22 Method step S23 Method step
X Axis

The invention claimed is:

1. A dosing device for dosing a detergent tablet to which the dosing device is attachable, the dosing device comprising:

a scoop; and a plug, wherein the scoop is configured to pick up a detergent tablet from the storage cartridge, lift the detergent tablet to an opening in the scoop and transport the detergent tablet to a receiving chamber formed in the plug when the scoop is turned in a first turning direction about a rotational axis that is perpendicular to a gravitational vector, and the plug is configured to release the detergent tablet from the receiving chamber.

2. The dosing device according to claim 1, wherein the scoop and the receiving chamber are implemented as a function of the geometry of the detergent tablets such that the dosing device is configured for dosing a predetermined number of detergent tablets, each time the dosing device is actuated for dosing the detergent tablet.

3. The dosing device according to claim 1 further comprising, a sealing portion configured for engaging with a corresponding sealing portion arranged on the storage cartridge configured for sealing an inner volume of the storage cartridge from the environment when the dosing device is attached to the storage cartridge.

4. The dosing device according to claim 1 further comprising a connector configured for engaging with a corresponding connector arranged on the storage cartridge configured for securely fixing the dosing device on the storage cartridge in a predefined relative angular position.

5. The dosing device according to claim 1, wherein the scoop comprises a pick-up portion configured for picking up the detergent tablet and lifting it to the opening in the scoop that leads to the receiving chamber, wherein a surface of the pick-up portion is formed as a spirally curved plane.

6. The dosing device according to claim 5, wherein a width of the surface of the pick-up portion of the scoop increases with an increasing diameter of the surface of the pick-up portion.

7. The dosing device according to claim 1 further comprising an engagement element configured for engagement with a driving device of an external driving unit for turning the dosing device in a first turning direction and for holding the dosing device fixed.

8. The dosing device according to claim 1, wherein the plug is held in the dosing device and is movable between a closed position and a release position, wherein when the plug is in the closed position, the detergent tablet received from the scoop is stored in the receiving chamber, and when the plug is in the release position, an outlet in a side-wall of the dosing device is cleared such that the detergent tablet stored in the receiving chamber is released, and wherein when the plug is in the closed position, a sealing portion is engaged such that the dosing device is sealed impermeably to fluids of all kinds.

9. The dosing device according to claim 1, wherein the plug is shaped as a cylinder, wherein an engaging section configured for engagement with a driving element of an external driving unit is arranged on one face of the cylinder and the receiving chamber is arranged on the other face of the cylinder, wherein the plug is arranged in the dosing device such that the receiving chamber is facing towards the opening of the scoop.

10. The dosing device according to claim 9, wherein the plug has an external thread that engages with an internal thread of the dosing device such that when the plug is rotated relative to the dosing device in a first rotation direction about a central axis of the cylinder, the plug is moved from a closed position to a release position by being displaced laterally away from the opening of the scoop, and when the plug is rotated relative to the dosing device in a second rotation direction oppositely the first rotation direction about the central axis, the plug is moved from the release position to the closed position by being displaced laterally towards the opening of the scoop.

11. The dosing device according to claim 9, wherein an inner surface of the plug delimiting the receiving chamber has an inclined plane with respect to the cylindrical outer surface of the plug in at least one section, such that the detergent tablet stored in the receiving chamber is actuated when the plug is moved from the closed position to the release position.

12. The dosing device according to claim 1 further comprising a lip that is arranged between the receiving chamber and the opening of the scoop and is configured for securely holding back the detergent tablet stored in the receiving chamber.

13. A storage cartridge for storing a plurality of detergent tablets to which a dosing device according to claim 1 is attachable, the storage cartridge comprising a container having an opening spanning a plane and an inner surface having a first helical indent in at least a portion of the inner surface for conveying the detergent tablets towards the opening when the container is turned about an axis that is perpendicular to the plane spanned by the opening, wherein at least one of a pitch and/or a height and/or a flank geometry and/or a flank angle and/or a gradient of the first helical indent are determined as a function of the size and/or geometry of the detergent tablets.

14. The storage cartridge according to claim 13, wherein the opening is arranged at one end of the storage cartridge to which the dosing device is attachable, wherein the storage cartridge comprises a connector configured for engaging with a corresponding connector arranged on the dosing device configured for attaching the dosing device to the storage cartridge on the opening in a predefined relative angular position.

15. The storage cartridge according to claim 14, wherein the predefined relative angular position is set such that a relative position between a leading edge of a pick-up portion of a scoop of the dosing device and an end-point of the first helical indent on the side of the opening correspond to each other.

16. The storage cartridge according to claim 13, wherein a second helical indent is formed in at least a portion of the inner surface of the container, wherein at least one of a pitch, a height, a flank geometry, a flank angle and/or a gradient of the second helical indent are different to at least one of the pitch, the height, the flank geometry, the flank angle and/or the gradient of the first helical indent and are selected such that detergent powder formed by abrasion from the detergent tablets stored in the storage cartridge is retained in the container when the container is turned for conveying the detergent tablets.

17. The storage cartridge according to claim 13 further comprising a sealing portion configured for engaging with a corresponding sealing portion arranged on the dosing device configured for sealing an inner volume of the storage cartridge from the environment when the dosing device is attached to the storage cartridge.

18. A dosing unit comprising a dosing device according to claim 1 and a storage cartridge, wherein the dosing device is attached to the storage cartridge.

19. A water-bearing household appliance comprising an automatic dosing system configured for automatically dosing a detergent tablet provided by a storage cartridge f configured or storing a plurality of detergent tablets into washing liquor for washing articles, comprising a receiving portion configured for receiving the storage cartridge and a driving unit configured for actuating a dosing device that is attachable to the storage cartridge for dosing the detergent tablet, wherein the dosing device is configured according to claim 1.

20. The water-bearing household appliance according to claim 19, wherein a dosing unit comprising the dosing device attached to the storage cartridge is arranged in the receiving portion.

21. A method for dosing a detergent tablet provided by a storage cartridge;

rotating the dosing unit in a first turning direction about a rotational axis that is perpendicular to a gravitational vector such that a scoop of the dosing device picks up a detergent tablet from the storage cartridge, lifts the detergent tablet to an opening in the scoop and transports the detergent tablet to a receiving chamber formed in a plug of the dosing device; and actuating for releasing the detergent tablet stored in the receiving chamber for dosing the detergent tablet.

22. A method for operating a water-bearing household appliance with an automatic dosing system configured for automatically dosing a detergent tablet provided by a storage cartridge configured for storing a plurality of detergent tablets into washing liquor for washing articles, comprising a receiving portion configured for receiving the storage cartridge and a driving unit configured for actuating a dosing device (100) that is attachable to the storage cartridge (200) for dosing the detergent tablet (202), comprising:

attaching the dosing device to the storage cartridge to form a dosing unit;

engaging driving element of the driving unit with the dosing unit;

rotating the dosing unit in a first turning direction about a rotational axis that is perpendicular to a gravitational vector by the driving element such that a scoop of the dosing device picks up a detergent tablet from the storage cartridge, lifts the detergent tablet to an opening in the scoop and transports the detergent tablet to a receiving chamber formed in a plug of the dosing device; and actuating the plug for releasing the detergent tablet stored in the receiving chamber for dosing the detergent tablet into the washing liquor.

* * * * *